US008375476B2

(12) United States Patent
Pollack et al.

(10) Patent No.: US 8,375,476 B2
(45) Date of Patent: Feb. 19, 2013

(54) ODOR REMOVAL SYSTEM

(75) Inventors: Nicholas R. Pollack, Moon, PA (US); William J. Aldridge, Coraopolis, PA (US)

(73) Assignee: Calgon Carbon Corporation, Pittsburgh, PA (US)

( * ) Notice: Subject to any disclaimer, the term of this patent is extended or adjusted under 35 U.S.C. 154(b) by 356 days.

(21) Appl. No.: 12/702,754

(22) Filed: Feb. 9, 2010

(65) Prior Publication Data

US 2010/0199413 A1 Aug. 12, 2010

Related U.S. Application Data

(60) Provisional application No. 61/150,883, filed on Feb. 9, 2009.

(51) Int. Cl.
*E03D 9/04* (2006.01)

(52) U.S. Cl. ..... 4/213

(58) Field of Classification Search ..... 4/213, 209
See application file for complete search history.

(56) References Cited

U.S. PATENT DOCUMENTS

| | | | | |
|---|---|---|---|---|
| 470,740 | A | 3/1892 | Bluhm | |
| 900,831 | A | 10/1908 | Charlton | |
| 980,916 | A | 1/1911 | Borger et al. | |
| 1,449,250 | A | 3/1923 | Ribley | |
| 2,021,402 | A | 11/1935 | Blodgett, Sr. | |
| 2,309,925 | A | 2/1943 | Schotthoefer | |
| 3,333,285 | A | 8/1967 | Null | |
| 3,579,650 | A | 5/1971 | Sloan | |
| 3,605,126 | A | 9/1971 | Henry | |
| 3,790,970 | A | 2/1974 | Bendersky et al. | |
| 4,222,130 | A * | 9/1980 | Roberts | 4/321 |
| 4,433,441 | A | 2/1984 | Schroeder | |
| 4,493,117 | A | 1/1985 | Sguazzin | |
| 4,586,201 | A | 5/1986 | Todd, Jr. | |
| 5,325,544 | A * | 7/1994 | Busch | 4/213 |
| 5,530,971 | A | 7/1996 | Anderson | |
| 6,163,893 | A | 12/2000 | Lo | |
| 6,733,239 | B2 | 5/2004 | Lee | |
| 6,754,912 | B1 * | 6/2004 | Hayashi et al. | 4/420.2 |
| 7,424,752 | B2 | 9/2008 | Antoniou | |
| 7,441,283 | B2 | 10/2008 | Chu | |
| 7,461,410 | B1 | 12/2008 | Shaffer | |
| 2006/0021120 | A1 | 2/2006 | Nickle | |

FOREIGN PATENT DOCUMENTS

| | | |
|---|---|---|
| WO | WO03/085214 A1 | 10/2003 |

* cited by examiner

*Primary Examiner* — Lori Baker
(74) *Attorney, Agent, or Firm* — Pepper Hamilton LLP

(57) ABSTRACT

An odor removal system and device are provided for removing odors from standard gravity fed and water pressure operated toilets. The system includes a fan assembly for directing air from the toilet bowl and overflow tube through a filter containing an appropriate filter material. It operates upon instruction from a mechanism designed to determine when the toilet is in use.

20 Claims, 11 Drawing Sheets

Fan Off

Fan On

ODOR REMOVAL SYSTEM

PRIORITY CLAIM

This application claims priority to U.S. Provisional Patent Application No. 61/150,883 filed on Feb. 9, 2009.

BACKGROUND OF THE INVENTION

Various devices have been used for eradicating bathroom odors. Perhaps most common are ventilation systems such as ceiling fans and air freshener devices. Ventilation systems draw air from the room to exhaust the odors. Often they disperse the odor particles before they can be removed. Air fresheners attempt to address odors by spraying chemical into the air or by emitting fragrance from an air freshener placed in the room. However, standard aerosol or gel air fresheners only mask unpleasant odors with a more pleasant smelling substance. Because they do not eliminate the odor at the source, the odor often permeates the room and there is a period of time when the offensive odors linger in the room.

There are also different types of deodorizing toilets. One, a deodorizing toilet seat, operates on a four-part deodorizing system that uses a carbon filter to absorb the odor and includes a fragrance vent for additional odor control. Another provides a deodorizing toilet seat pad. The pad is attached to the toilet seat and a fan is mounted at the air outlet of the toilet. A carbon container is located on the outside of the fan. Another is a compact deodorizer having a one-way valve for the inlet of gases and a motor-driven fan. It is located on the toilet and is easily removed the air intake device is located on the bowl beneath the seat. There is also a portable apparatus mountable to the toilet bowl rim and seat bottom.

These all have the disadvantage of requiring an attachment apparatus on the bowl of the toilet or a toilet seat. Some have the further disadvantage of being large systems that attach outside the toilet. They often fail to remove the odors and thus do not prevent the odors from escaping to the room or provide an effective means of eliminating foul odors in the bathroom.

SUMMARY OF THE INVENTION

In various embodiments, the present invention is directed to an odor removal device for removing odors from a toilet. In embodiments, the device has three primary components: a fan assembly, a replaceable filter and a sensor. In embodiments, the device can be easily installed to the overflow tube in the back tank of a standard gravity fed toilet. It is designed to adapt to almost all household and commercial gravity fed and pressure assisted toilets. Alternatively, the odor removal device is integrated with an original equipment toilet during manufacture.

In various embodiments, the present invention operates automatically when the toilet is being used.

In various embodiments, the present device is generally hidden from site within the toilet water reservoir of a gravity fed toilet, rather than as an attachment apparatus on the bowl of the toilet or toilet seat. For pressure assisted systems, the device is attached to the water feed line to the toilet in an unobtrusive location. In addition to the advantageous location, the device is designed to capture and eliminate odors before they enter the room providing a safe and simple alternative to traditional bathroom air fresheners and ventilation systems.

Other embodiments, features, aspects and advantages of the present invention will become better understood or apparent from the following detailed description, drawings, and appended claims of the invention.

BRIEF DESCRIPTION OF THE DRAWINGS

The accompanying drawings illustrate examples of embodiments of the present invention. In such drawings.

DETAILED DESCRIPTION OF EXAMPLES OF THE INVENTION

Figure 1:
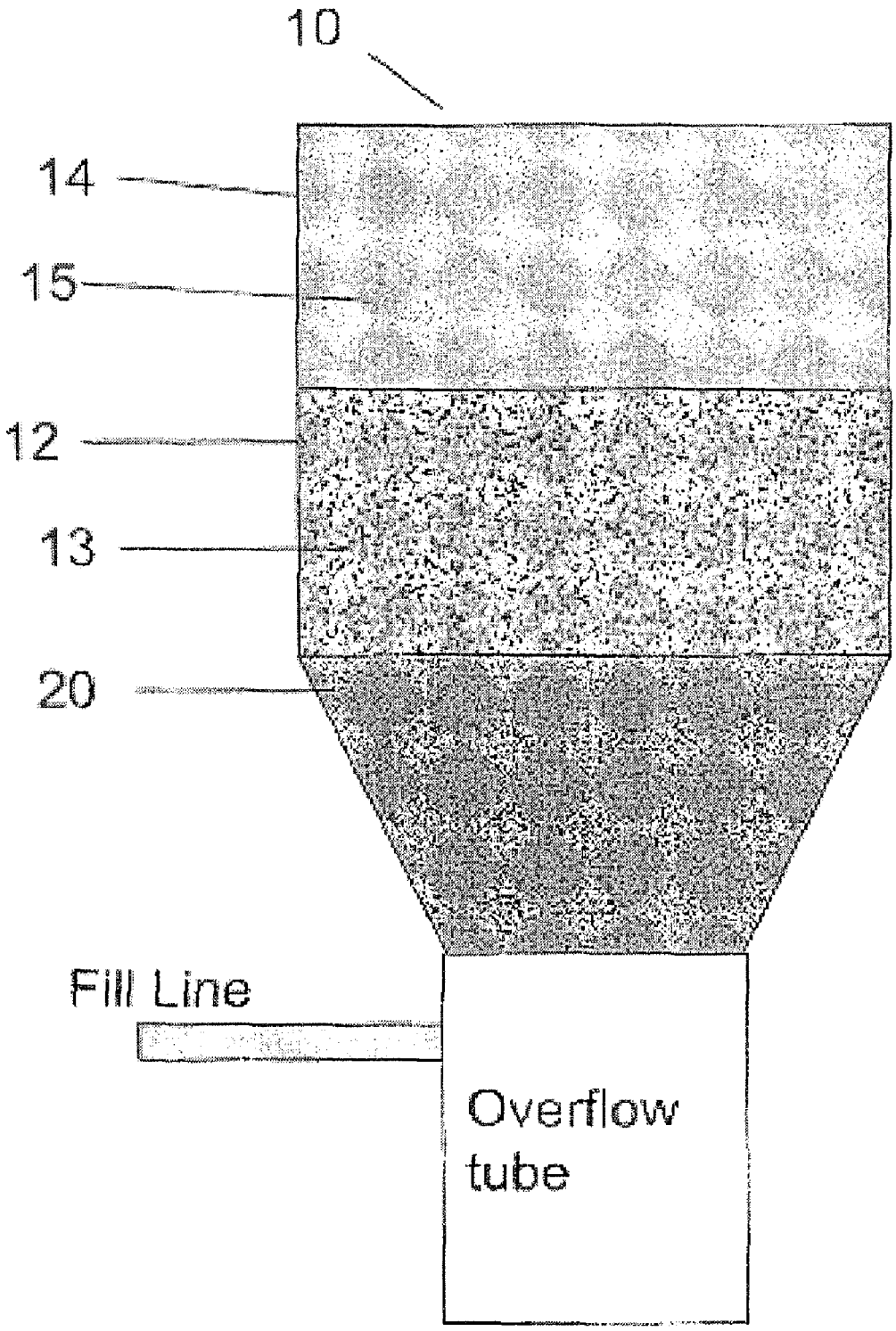
FIG. 1 shows a view of the odor removal device according to an embodiment of present invention.

In general, an embodiment of the invention is shown as the odor removal device 10 illustrated in FIG. 1. Device 10 includes a generally hollow body with a neck 20 that attaches at one end to the outlet of an overflow tube in a standard gravity fed toilet, and attaches at the other end to a first portion 12. The opposite end of first portion 12 attaches to a second portion 14. The first portion 12 contains a filter 13 with active filter material. In an example, the second portion 14 houses a fan assembly 15 that draws air from the bowl of the toilet and overflow tube and through the filter 13 of first portion 12. As the air passes through the filter 13 in the first portion 12, the odors contained in the air are adsorbed into and or destroyed by the active filter material. The air travels through first portion 12 and second portion 14 resulting in cleaner odor free air that is then discharged back into the room from the second portion 14. The body of the device 10 may be made of plastic, metal or any other material suitable for the use in a toilet.

Figure 2:
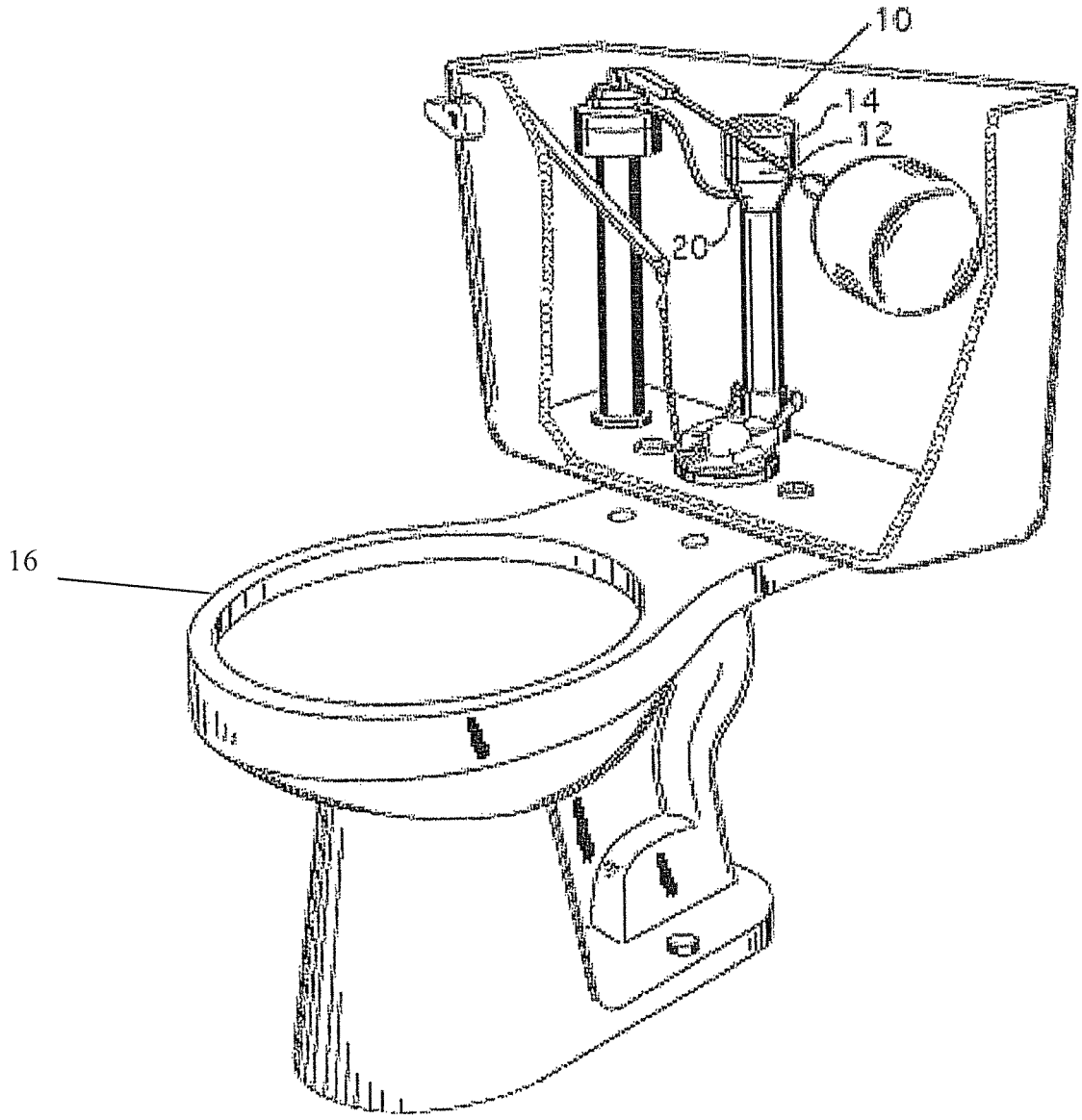
FIG. 2 shows a view of a toilet system with an odor removal device attached to the overflow tube in the toilet tank according to example of present invention.

The neck 20 is formed in the device 10 to attach first portion 12 to the top of an overflow tube of a standard gravity flow toilet. The attachment of neck 20 is designed to provide a tight fit with the overflow tube and, optionally, can be removable. This may be accomplished by making neck 20 of a formable material having a diameter that is generally the same size or slightly larger than that of the diameter of the overflow tube so that the end of the neck 20 fits over the tube like a sleeve. Alternatively the neck may contain threads that would mateup with a threaded overflow tube. This configuration of the device 10 adapted to a standard gravity flow toilet is illustrated for example in FIG. 2.

Figure 3:
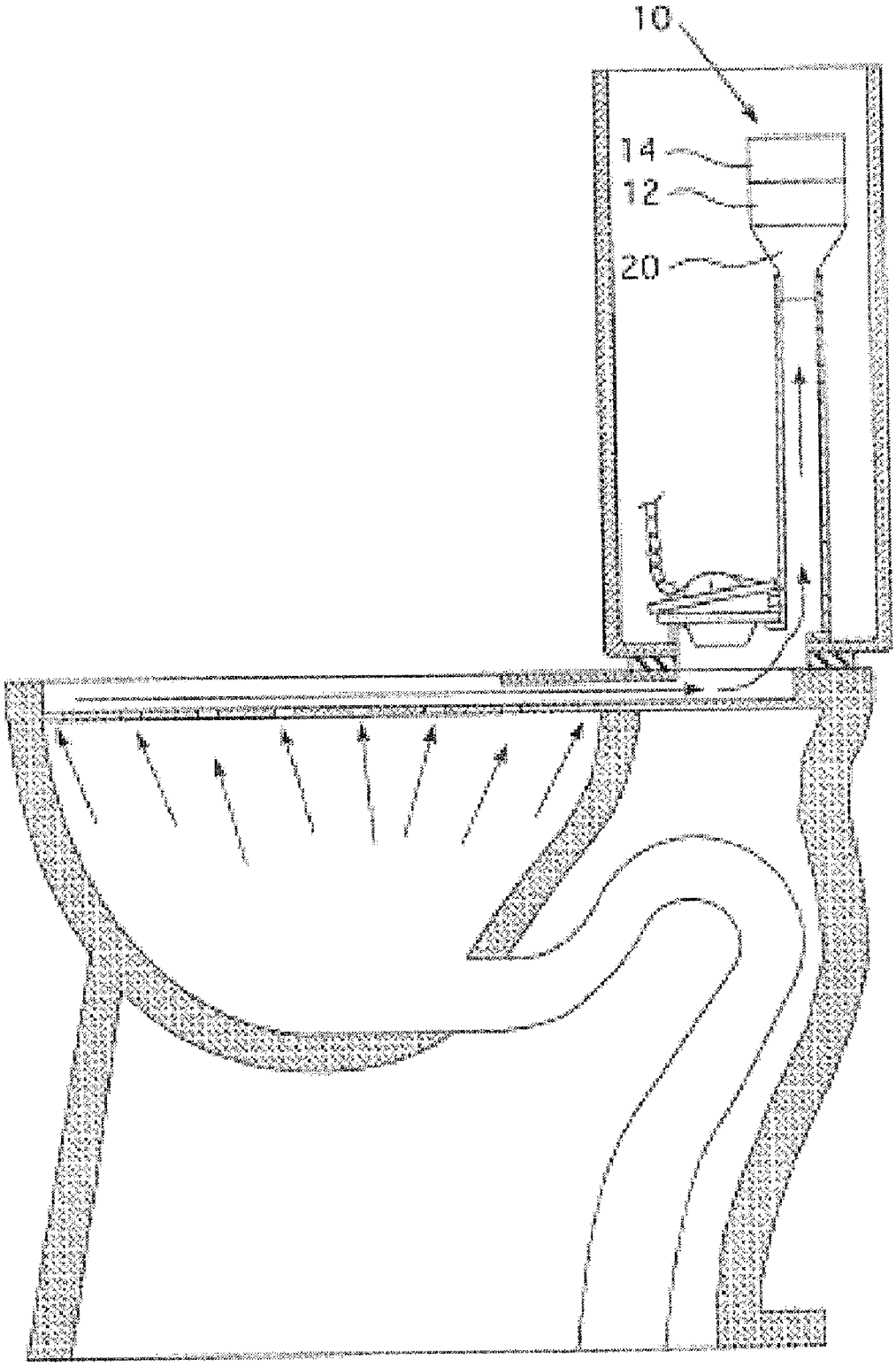
FIG. 3 is a schematic view of a toilet system according to an embodiment of present invention.

FIG. 3 shows the current of the air flow from the bowl through the tube and into the device 10 where it is treated in the filter 13 as indicated by the arrows. The device 10 takes advantage of the existing water pathway from the tank to the bowl, which exists in all toilets, to draw air from the bowl, through the water pathway and into the device located in the tank. The position of device 10 in the toilet accommodates for the fill line while maintaining tank overflow protection should the fill mechanism fail. Thus if the fill valve were to fail, water would be able to travel down through the device 10 and through the overflow tube and back into the toilet bowl.

The filter 13 may contain one or a combination of active filter materials to remove or destroy the odors. Sorbents such as activated carbon, zeolites, carbonized polymers, etc can be used to adsorb the odors. Chemicals such as baking soda can be used to react with the odors thereby sequestering the odors. Finally, catalysts such as supported precious metal catalysts can be used to oxidize and convert the odors to carbon dioxide and water or some other incomplete oxidation product that is less odorous and relatively safe. Filter 13 may contain any one or more of these materials.

In embodiments the fan assembly 15 draws air up through first portion 12 and into filter 13 as a motive air force. For an example, the fan assembly 15 can be an aspiration or venturi type device that would use the house water to create a vacuum and draw the air into and through portion 12. In examples, the fan assembly 15 can be a small fan sized to fit within the second portion 14 of the device 10. In embodiments it is similar in size to a computer fan that could be powered by a single 9 volt battery. In examples, the fan rating is approximately 3.0 CFM which would effectively recycle the air in the bowl every 20 seconds based on a typical bowl size of 1 $ft^3$. Adjustments can be made to accommodate the toilet with which the device is used.

Figure 4:
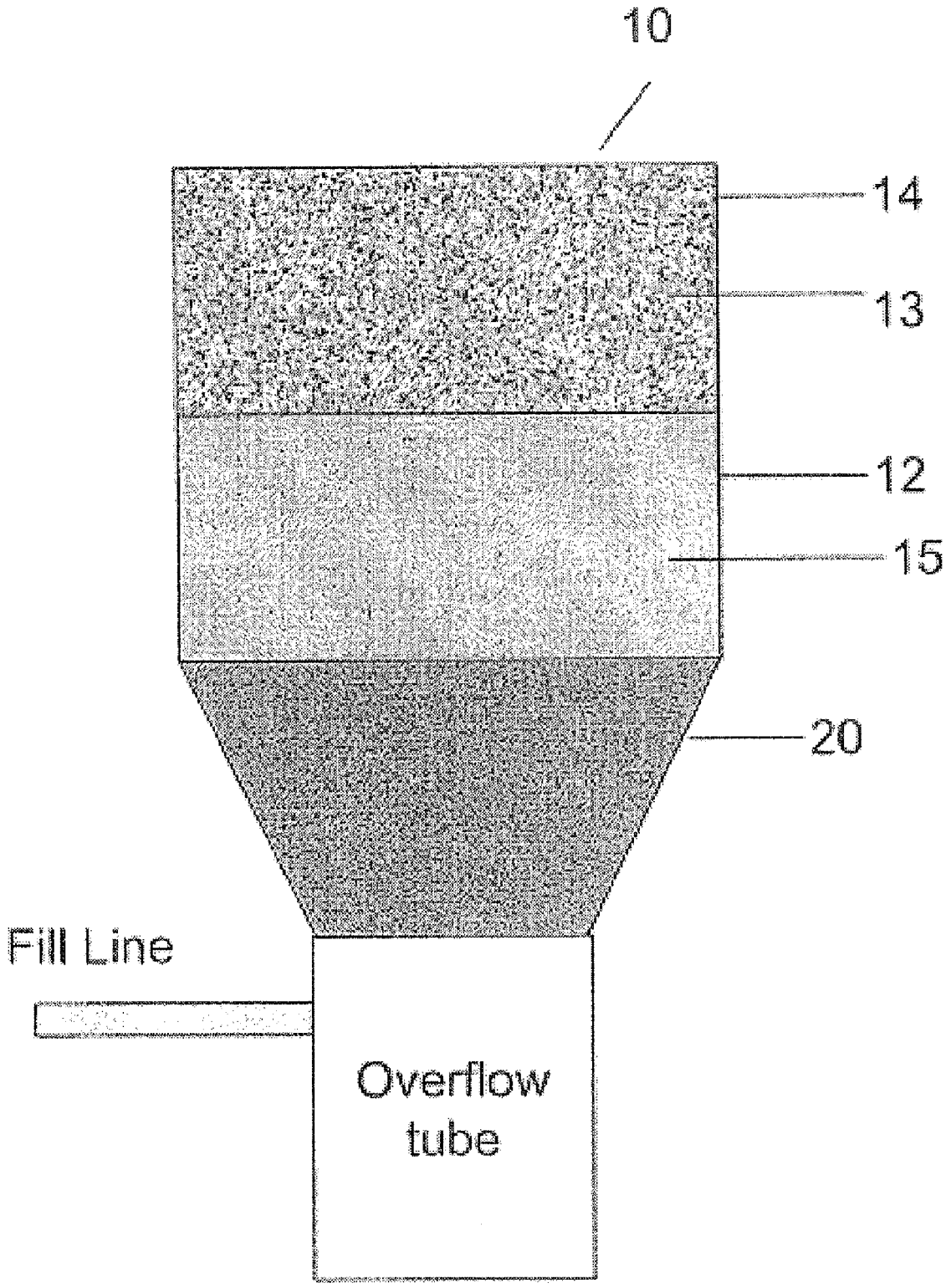
FIG. 4 illustrates a view of the device according to an embodiment of the present invention.

In alternative embodiments shown for example in FIG. 4, the first portion 12 contains the fan assembly 15 and second portion 14 contains the filter 13. Here the motive air force blows the air from the first portion 12 up into the second portion 14 and through the filter media. Alternate geometries may need to be considered to efficiently adapt to and account for range of different toilets. For example, where space is limited between the tank water and its cover, an elbow joint could be used to practice the device. As the air passes through the filter 13, odors are removed.

The odor removal system further comprises a sensor 16 to detect use of the toilet. Sensor 16 is arranged to communicate with the fan assembly 15 and activate it in response to a detection. When activated the sensor 16 completes an electrical circuit that triggers operation of the fan assembly 15. The fan assembly 15 draws air from the toilet bowl into the rim of the toilet, up the overflow tube and directs the current of air into the device 10 and through the filter 13. Operation continues during and until the bowl has refilled with water, and for so long as the sensor detects usage. After a few minutes with no detection the fan will once again shut off.

The detection sensor 16 can be wired or wireless, such as infrared, magnetic or bluetooth technology. In an example, sensor 16 is a light sensitive photocell. In an example, sensor 16 is pressure sensitive. A pressure sensor may be located under the toilet seat and in contact with the rim of the toilet bowl. In an example, a pressure sensor replaces one of the feet typically located under the edge of a lid. In another example, the sensor 16 is an electronic eye or motion sensor advantageously placed in the room or on the toilet to detect use of the toilet.

Figure 5:
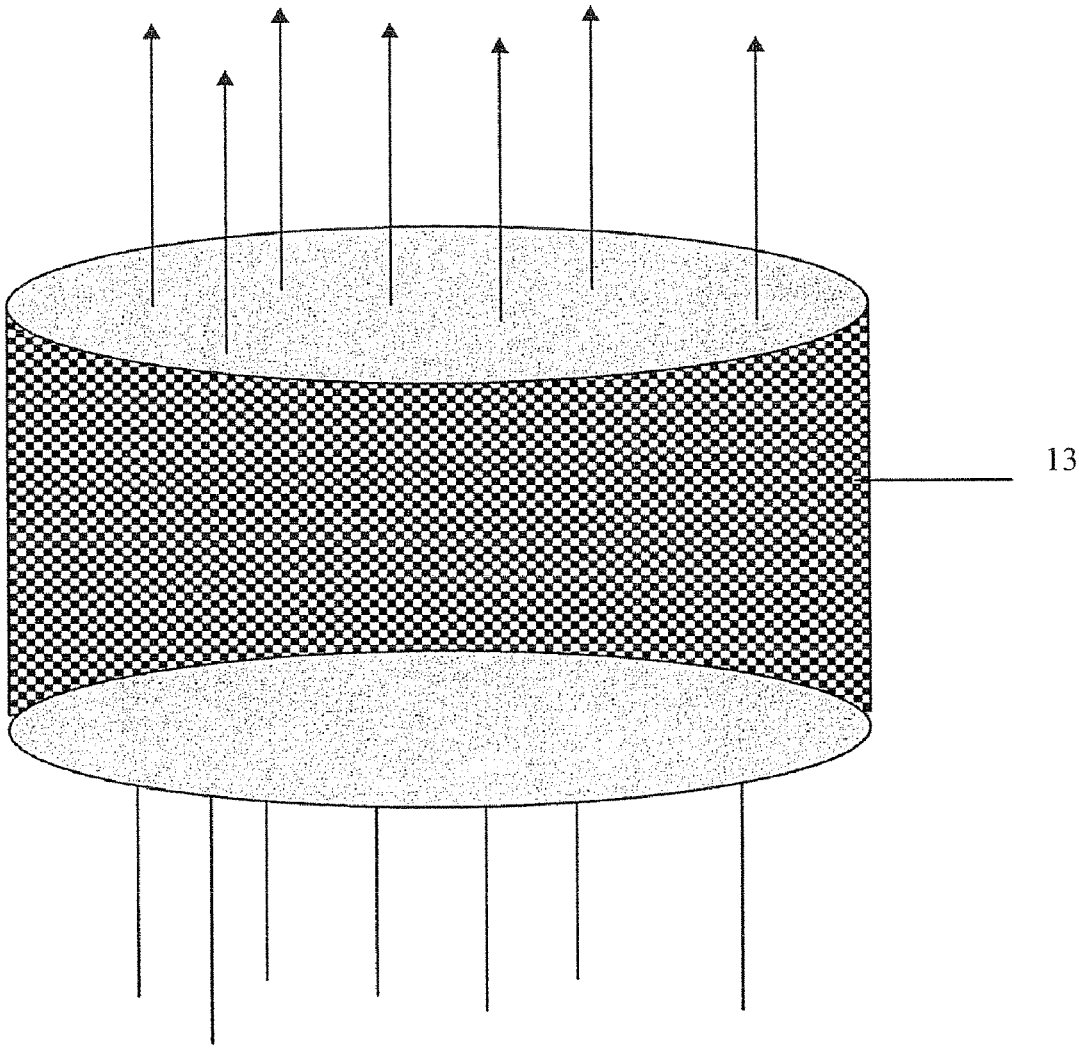
FIG. 5 illustrates a view the odor removal device having a fixed bed according to an embodiment of the present invention.
Figure 6:
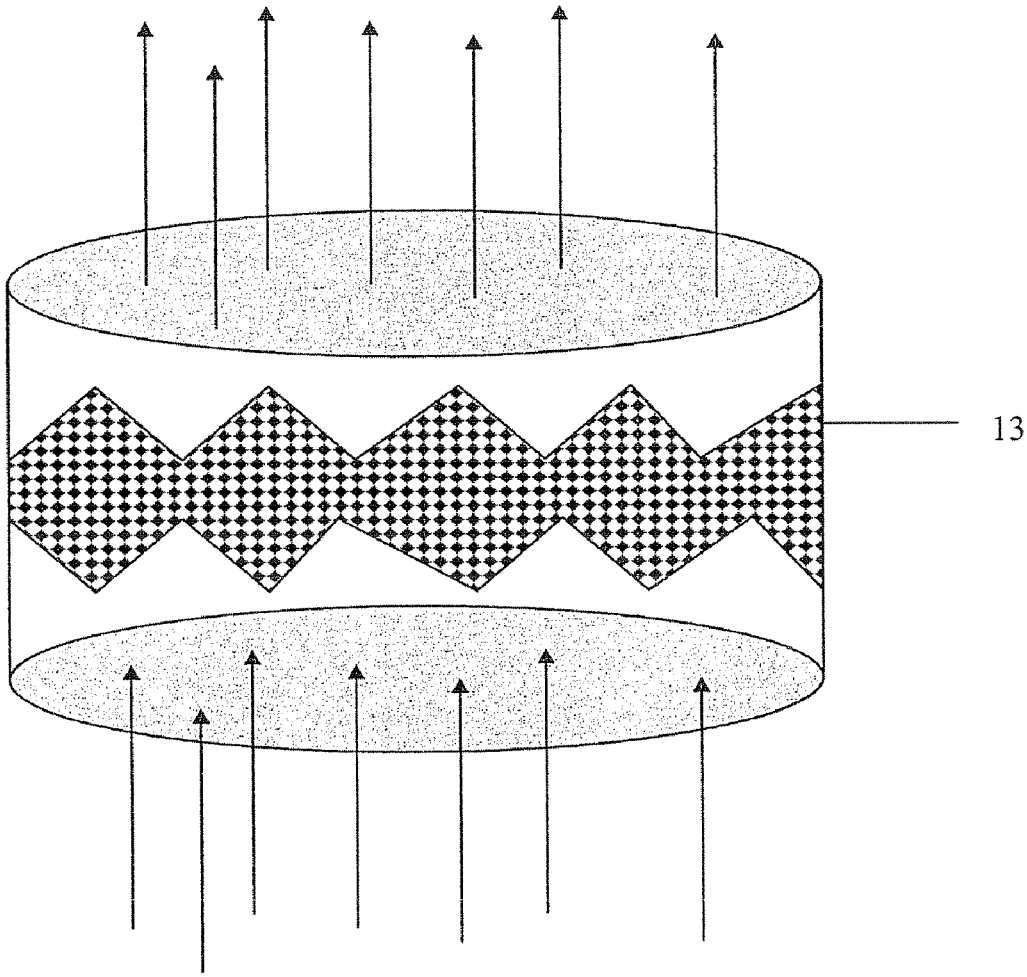
FIG. 6 illustrates a view of the odor removal device having a pleated sorbent bed according to an embodiment of the present invention.
Figure 7:
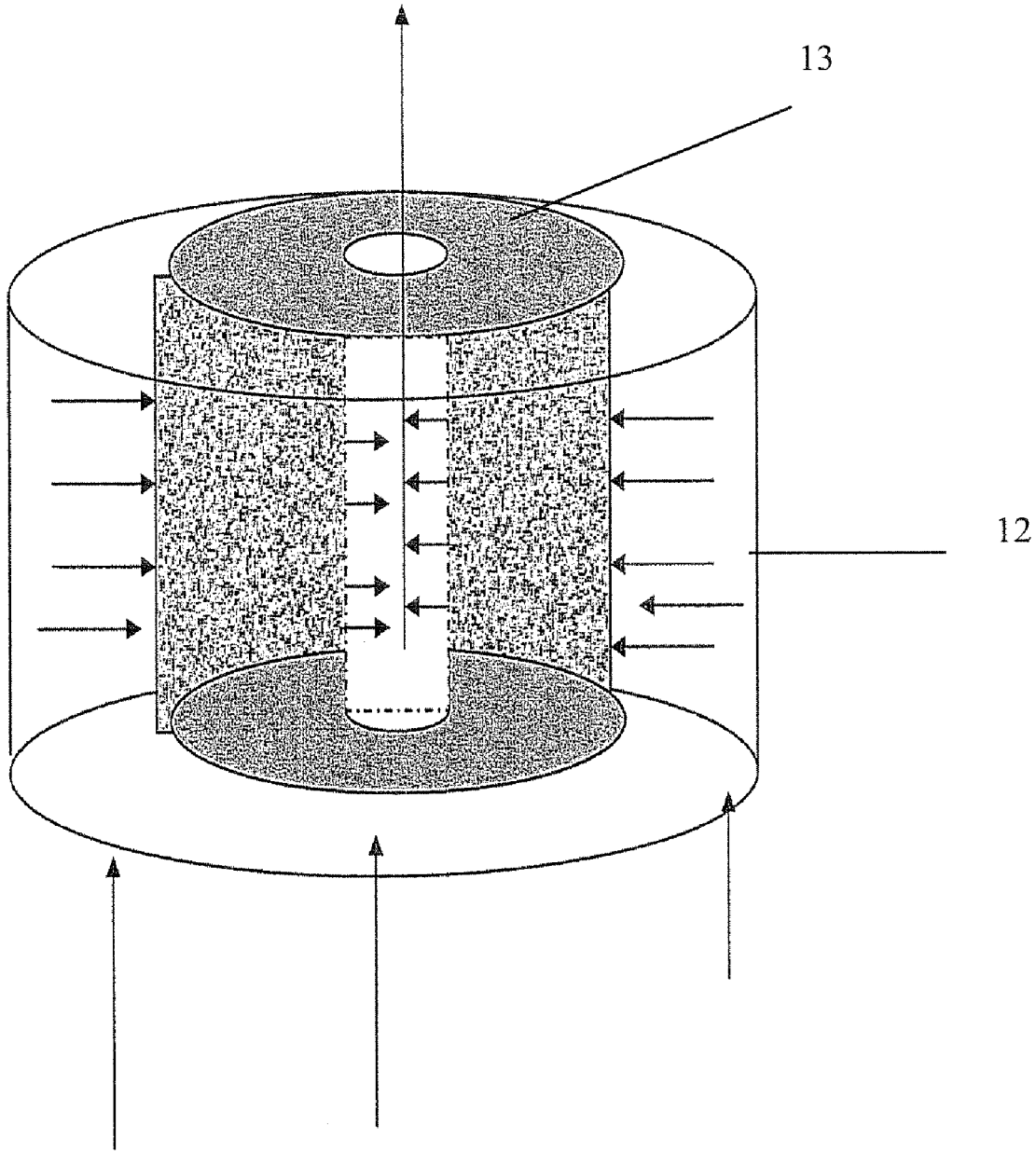
FIG. 7 illustrates a view of the odor removal device having a radial flow sorbent bed according to an embodiment of the present invention.

In embodiments the filter 13 includes a replaceable cartridge packed with active filter material. In examples, the active filter material is designed to have an approximate lifespan of 1-2 months. The replaceable filter 13 can take the form of a fixed bed, as illustrated in FIG. 5; a pleated bed as illustrated in FIG. 6; or a radial flow bed as illustrated in FIG. 7; or a combination, for examples. The active filter material can be either granular, palletized, spherical, impregnated cloth, spiral tape containing powdered active filter material, or some form of active filter fabric, such as activated carbon cloth.

Figure 8:
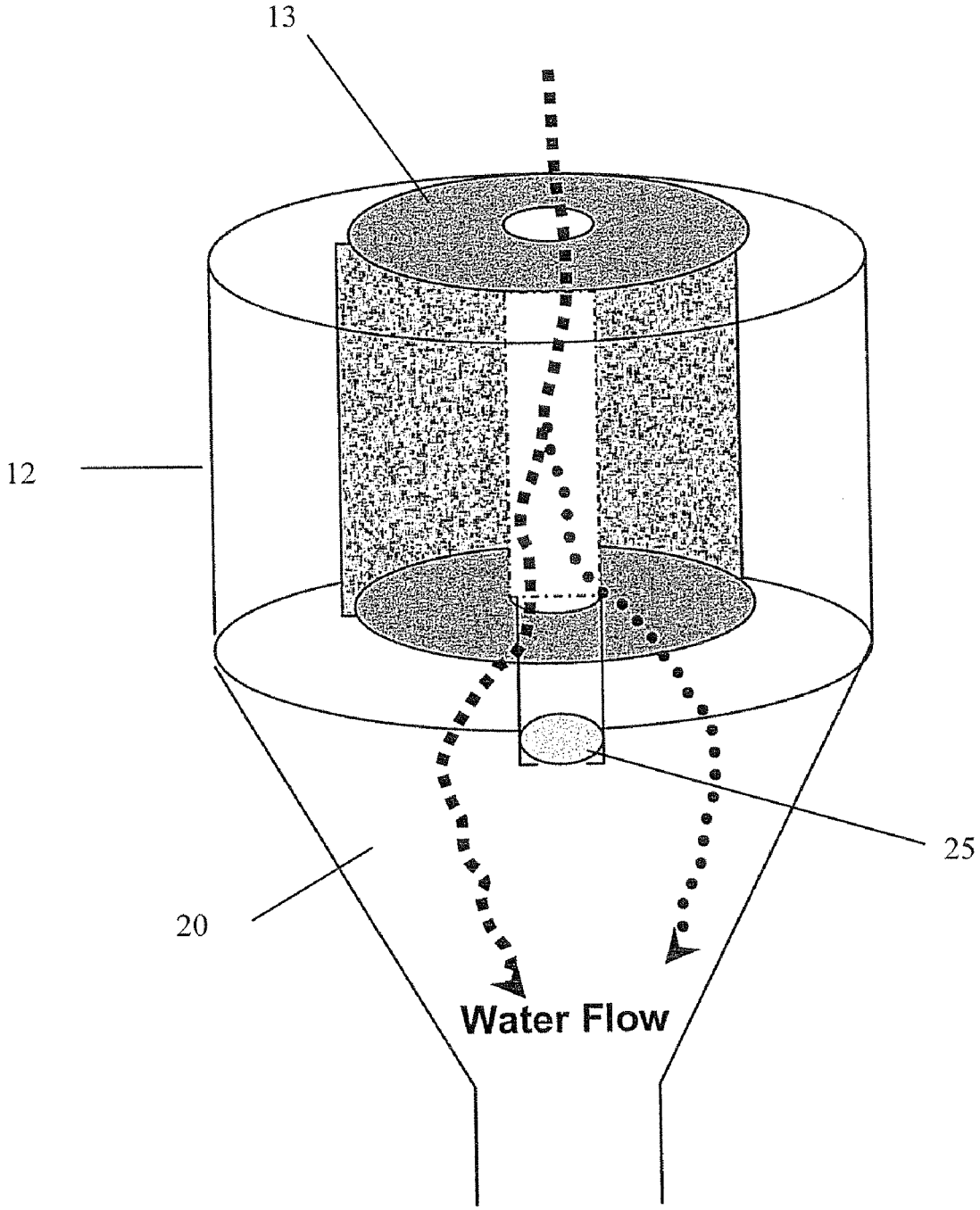
FIG. 8 illustrates a view of the odor removal device having a radial flow sorbent bed with a check valve to enable water to flow through the device without wetting the sorbent, according to an embodiment of the present invention.
Figure 9:
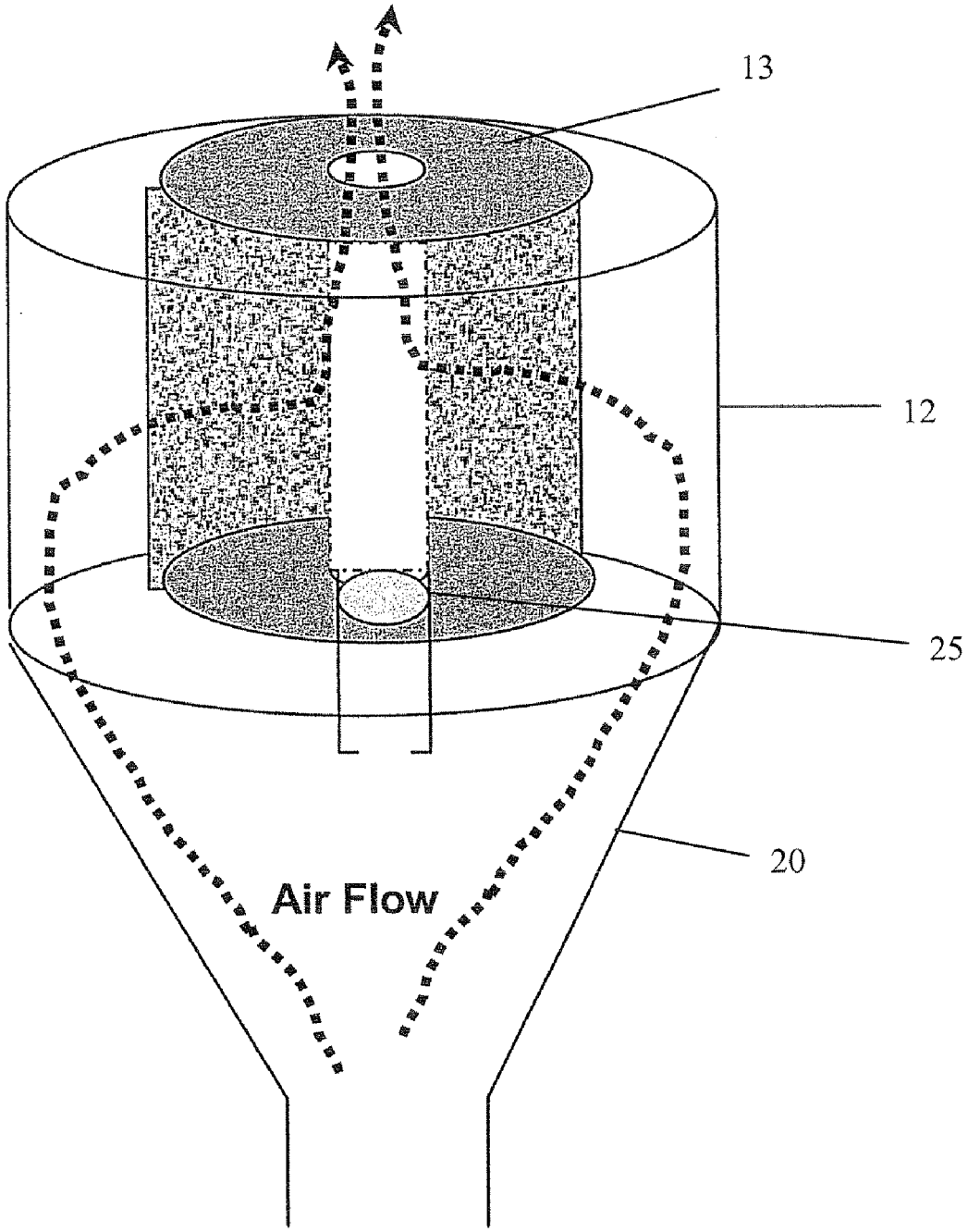
FIG. 9 illustrates an embodiment of the device having a radial flow sorbent bed.

In embodiments, a ball 25 can be placed below the center opening of the radial flow bed, for an example, as shown in FIGS. 8 and 9. The ball 25 functions as a check valve to enable water flow through the device 10 without wetting the active filter material. Under normal operations, when the fan is on (FIG. 9), the ball moves to the closed position which forces the air to flow through the active filter material. When the fan is off (FIG. 8), the ball is in the open position which allows water to flow down through the center of the filter device, in the case of tank failure event, thereby eliminating the possibility of water contacting and damaging the active filter material.

Figure 10:
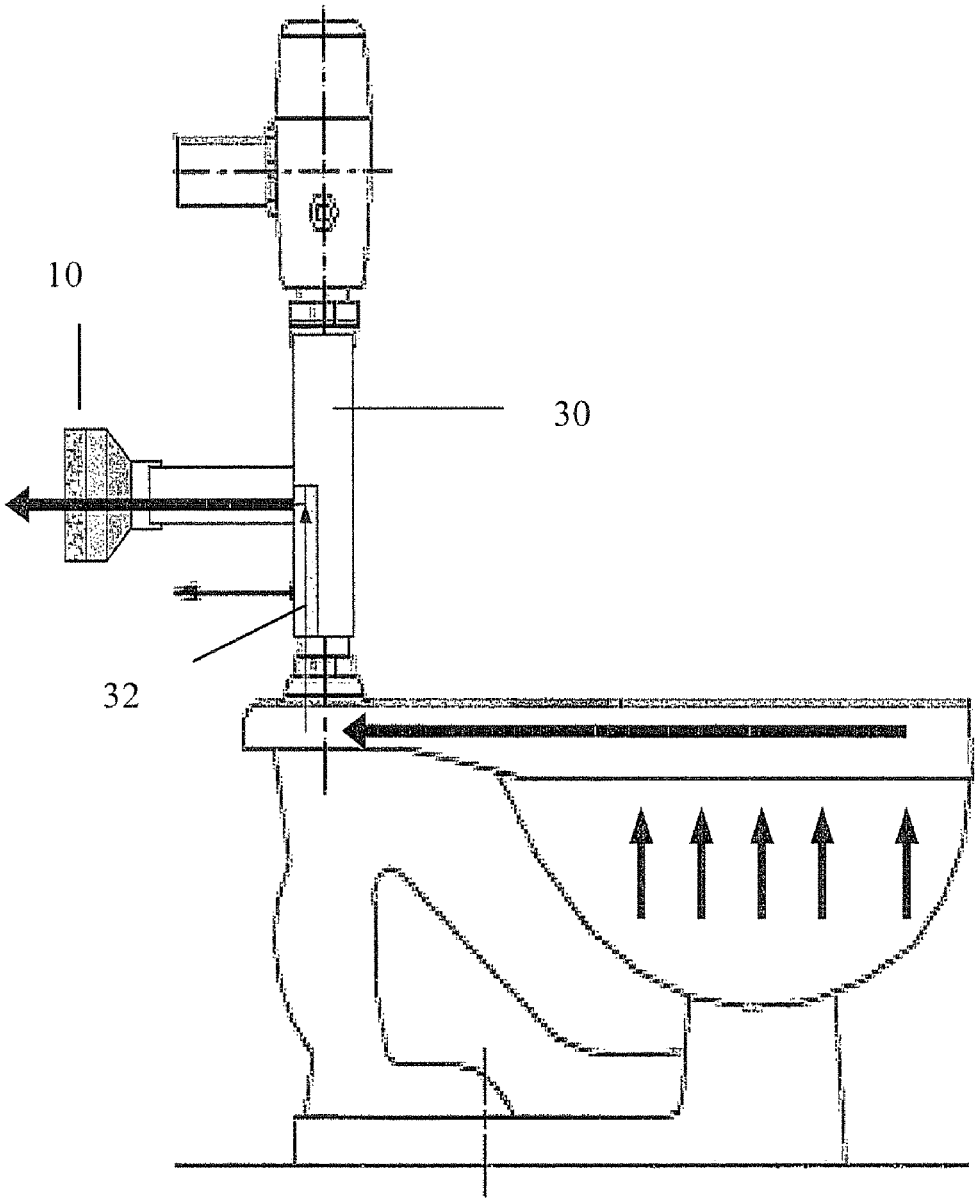
FIG. 10 illustrates an embodiment of the device with a tee adaptor to fit a toilet that operates with pressurized water.
Figure 11:
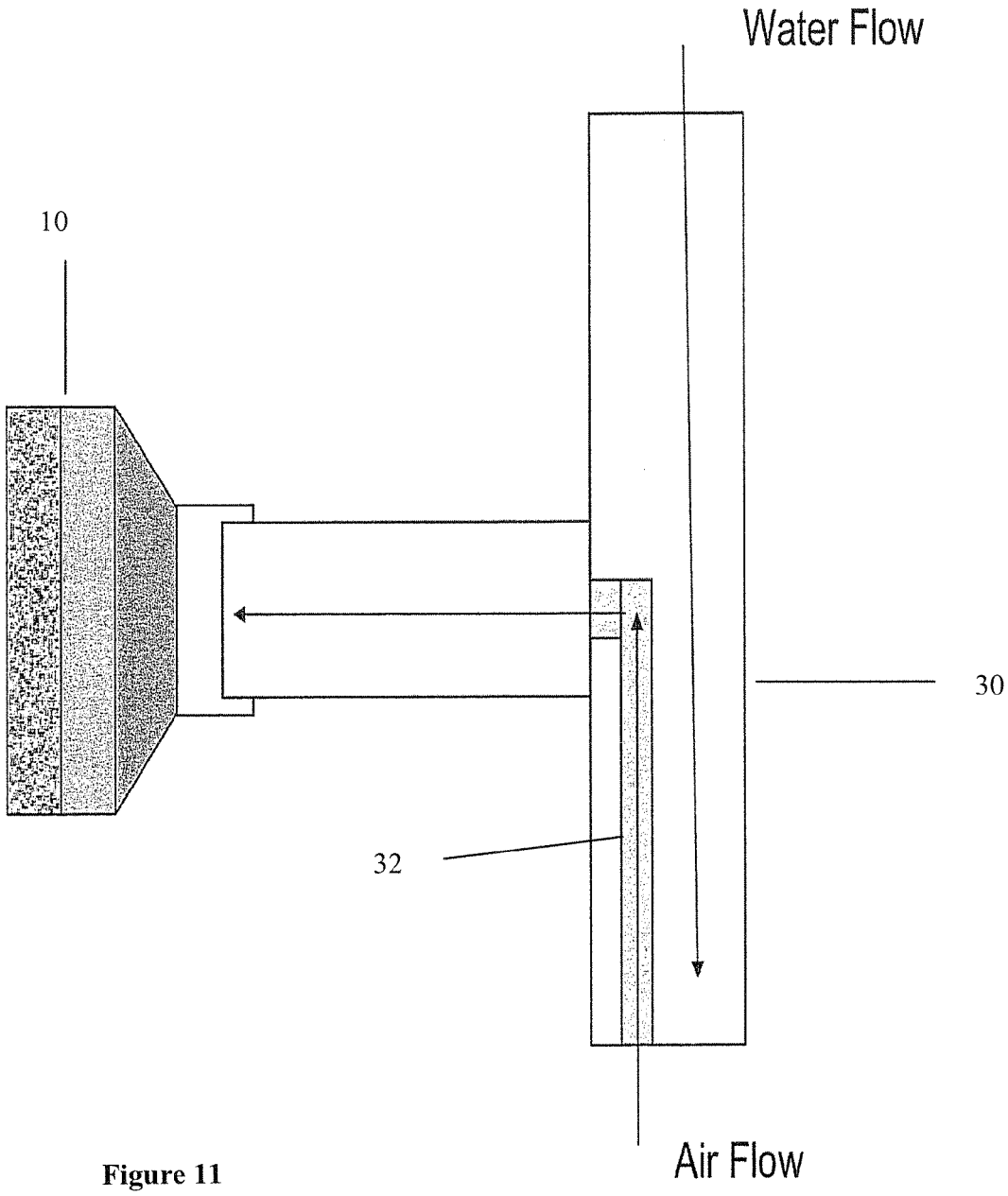
FIG. 11 illustrates an embodiment of the device attached to a tee adapter.

In embodiments, the device 10 can be attached to a toilet that uses a pressurized water supply as shown in FIG. 10, such as typical commercial toilets. In this embodiment, the device 10 is attached to a tee adapter 30 that is inserted directly below the flush valve on a standard pressurized valve device. Inside the tee adapter 30 there is a drop tube 32, as shown in FIG. 11, that travels down the tee far enough to prevent pressurized water from flowing back through the device thereby protecting the filter material.

In various embodiments of the present invention when a person sits to use the toilet the sensor 16 will be activated and the electrical circuit to the fan 15 will close. In turn the fan will move air from the toilet bowl through the activated carbon filter 13. After a few minutes with no motion the sensor will signal the fan and the fan will once again shut off. Various configurations may be used.

It should be understood that the principles of the subject invention are not limited to any particular dimensional size or materials of construction, and furthermore, it is not limited to the embodiments shown for illustration. It should also be understood by those skilled in the art that various modifications can be made to this system and device while still falling within the purview of the overall principals of the subject invention.

What is claimed is:

1. An odor removal device comprising:

a hollow body having a first end removably attached to an outlet of an overflow tube in a gravity fed toilet and a second end for exhausting air therefrom;

a filter positioned between the first and second ends of the hollow body, the filter comprising an adsorbent; and a fan assembly positioned in said body to direct a current of air from a bowl of the toilet and overflow tube, through the filter and out the second end.

2. The device of claim 1 further comprising a mechanism for activating the fan assembly when the toilet is in use.

3. The device of claim 2, wherein the mechanism is a light sensitive photo cell, magnetic sensor, motion sensor, infrared sensor, pressure sensor, or bluetooth sensor.

4. The device of claim 1, wherein the filter contains carbon, activated carbon, zeolite, carbonized polymer, catalyst, baking soda, or a combination thereof.

5. The device of claim 1, wherein the filter comprises a fixed bed, a pleated bed, or a radial flow bed.

6. The device of claim 1, wherein the filter comprises a check valve.

7. The device of claim 1, wherein the filter is a replaceable cartridge.

8. A odor removal device comprising:

a hollow body having a first end removably attached to a side of an overflow tube in a water pressure fed toilet and a second end for exhausting air therefrom;

a filter positioned between the first and second ends of the hollow body, the filter comprising an adsorbent; and a fan assembly positioned in said body to direct a current of air from a bowl of the toilet and overflow tube, through the filter and out the second end.

9. The device of claim 8, further comprising a sensor positioned to determine when the toilet is in use and adapted to communicate with the fan assembly.

10. The device of claim 9, wherein the sensor is selected from the group consisting of a light sensitive photo cell, a magnetic sensor, a motion sensor, an infrared sensor, a pressure sensor, and a bluetooth sensor.

11. The device of claim 8, wherein the adsorbent is selected from the group consisting of carbon, activated carbon, zeolite, carbonized polymer, catalyst, baking soda, and combinations thereof.

12. The device of claim 8, wherein the filter comprises a fixed bed, a pleated bed, or a radial flow bed.

13. The device of claim 8, wherein the filter comprises a check valve.

14. An odor removal system comprising:

a toilet having a water tank with a water outlet attached to a toilet bowl;

an overflow tube having an open end and an opposite end positioned in the water tank to open into the toilet bowl and to manage excess water in the water tank from overflowing; and a device having first end attached to the overflow tube and a second end for exhausting air therefrom;

a filter positioned between the first and second ends of the device, the filter comprising an adsorbent; and a fan assembly positioned in the device to direct a current of air from the toilet bowl, to the overflow tube, through the filter and out the second end.

15. The system of claim 14, wherein the toilet is a gravity fed toilet wherein the first end of the device is attached to the open end of the overflow tube.

16. The system of claim 14, wherein the toilet uses a pressurized water supply, wherein the first end of the device is attached to the side of the overflow tube below water in the water tank.

17. The system of claim 14 further comprising a sensor for activating the fan assembly when the toilet is in use, wherein the sensor is selected from the group consisting of a light sensitive photo cell, a magnetic sensor, a motion sensor, an infrared sensor, a pressure sensor, and a bluetooth sensor.

18. The system of claim 14, wherein the filter contains carbon, activated carbon, zeolite, carbonized polymer, catalyst, baking soda or a combination thereof.

19. The system of claim 14, wherein the filter comprises a fixed bed, a pleated bed, or a radial flow bed.

20. The system of claim 14, wherein the filter comprises a check valve.

* * * * *